US006106131A

United States Patent [19]

Hao

[11] Patent Number: 6,106,131

[45] Date of Patent: Aug. 22, 2000

[54] KEY LIGHT HOLDER FOR KEY ORGANIZATION

[76] Inventor: Da L Hao, 12961 Ramona Blvd., Unit F, Irwindale, Calif. 91706

[21] Appl. No.: 09/120,954

[22] Filed: Jul. 22, 1998

[51] Int. Cl.[7] ..... A44B 15/00; F21V 33/00

[52] U.S. Cl. ..... 362/116; 362/800; 70/457; 70/459

[58] Field of Search ..... 362/116, 200, 362/800, 201; 70/456 R, 457, 459, 429, 430

[56] References Cited

U.S. PATENT DOCUMENTS

| | | | |
|---|---|---|---|
| 4,085,315 | 4/1978 | Wolter et al. | 362/116 |
| 4,276,582 | 6/1981 | Burnett | 362/116 |
| 4,303,966 | 12/1981 | Wolter | 362/116 |
| 5,573,109 | 11/1996 | Isacson | 362/116 |
| 5,730,013 | 3/1998 | Huang | 362/116 |

*Primary Examiner*—Thomas M. Sember
*Attorney, Agent, or Firm*—Raymond Y. Chan; David and Raymond

[57] ABSTRACT

A key light holder for key organization has a key organizer device for organizing keys in key chain and a light device for illumination when the key is used in dark. The holder is a thin hard box having a round shape in top and square shape in bottom. The light device contained in the holder can be turned on and off. The key organizer device contained in the holder has a drawing back force when a pull out force applies to the device.

19 Claims, 6 Drawing Sheets

KEY LIGHT HOLDER FOR KEY ORGANIZATION

BACKGROUND OF THE PRESENT INVENTION

The present invention relates to a metal made key holder, and more particularly to a key light holder for key organization that has a key organizer device for organizing keys in key chain and a light device for illumination when the key is used in dark.

SUMMARY OF THE PRESENT INVENTION

The main object of the present invention is to provide a key light holder for key organization that enables a user to more easily and conveniently select a key in dark and organize his or her keys.

Another object of the present invention is to provide a key light holder for key organization, by which when one key is selected to use; the other keys will still be organized without jam or noise.

DETAILED DESCRIPTION OF THE PREFERRED EMBODIMENT

Referring to FIGS. 1 to 11, a key light holder 10 for key organization according to a preferred embodiment of the present invention is illustrated.

Figure 6:
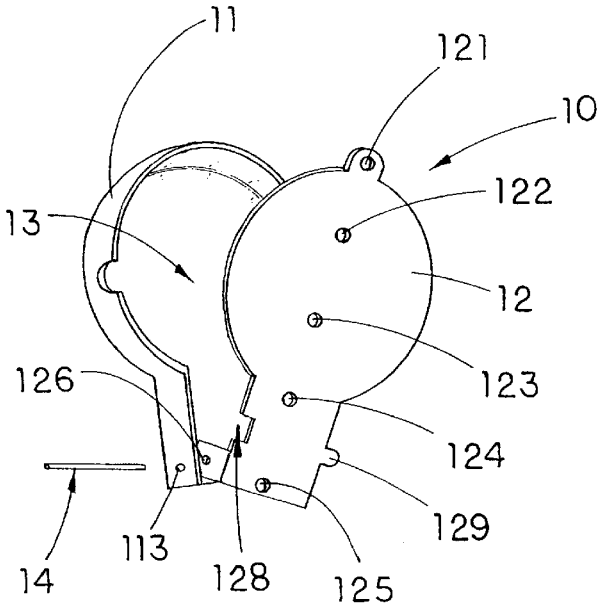
FIG. 6 is a schematic view illustrating a pin to connect the front and back panels according to the above preferred embodiment of the present invention.
Figure 7:
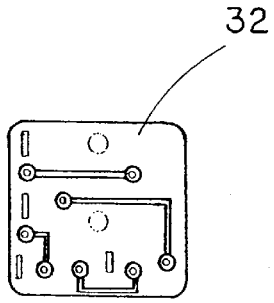
FIG. 7 is front view of a light device circuit board of the key light holder according to the above preferred embodiment of the present invention.

The key light holder comprises a holder 10, a key organizer device 20 and a light device 30. The holder 10 comprises a front panel 11 connected with a back panel 12 to define a receiving chamber 13 therein, as shown in FIG. 6.

The key organizer device 20 is affixed in the holder 10 and comprises a thread 21 having a first end 22 capable of being extended from the holder 10 for organizing keys 40 when a pulling force is applied to the first end of the thread 21, and a self retractable thread device 23 for retracting the thread 21 back into the holder 10 when the pulling force is released.

The front panel 11 and the back panel 12 are shaped by Pneumatic Press from thin metal, such as brass, stainless steel or flexible steel, to form a holder. These metals are found available in local steel suppler. These thin metals can be cut, bent and punched to form a shape. A small light device 30 and the key organizer device 20 are affixed inside the holder 10.

Figures 1, 2, 3:
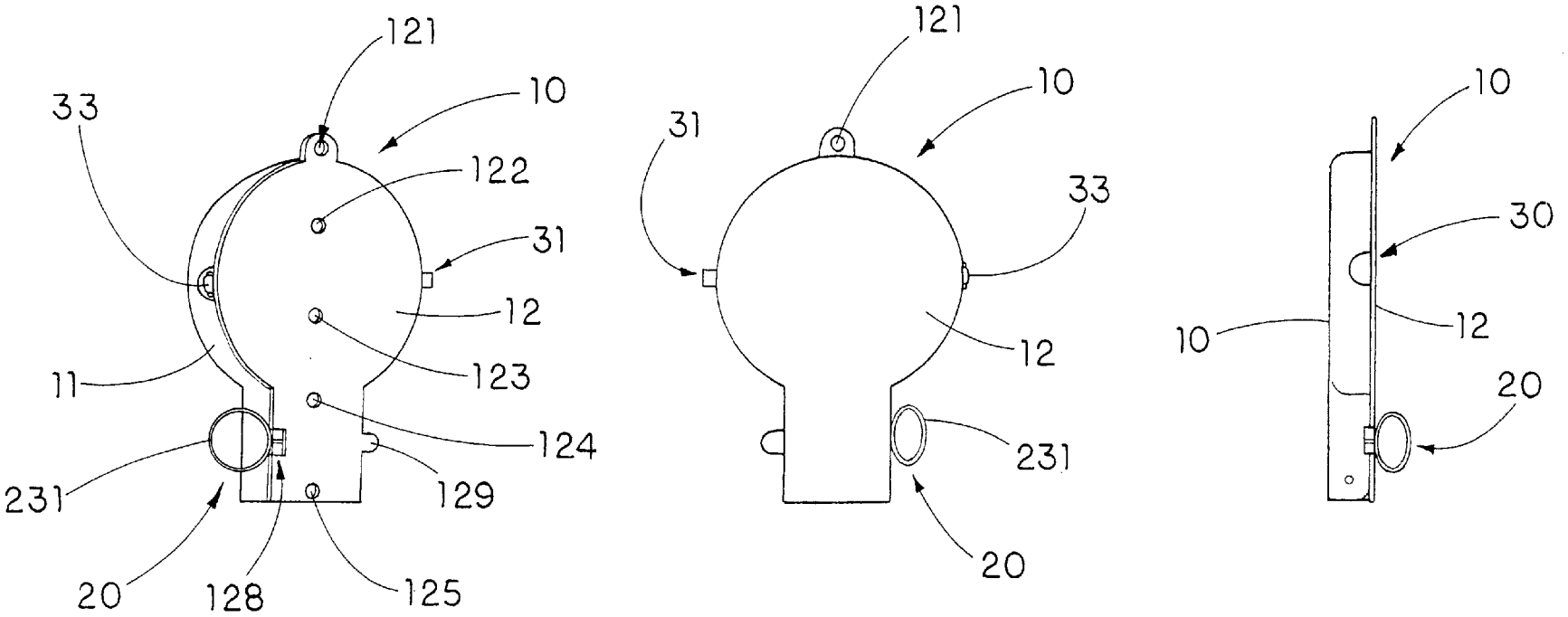
FIG. 1 is a perspective view of a key light holder according to a preferred embodiment of the present invention.
FIG. 2 is a front view of the key light holder according to the above preferred embodiment of the present invention.
FIG. 3 is a side view of the key light holder according to the above preferred embodiment of the present invention.
Figure 4:
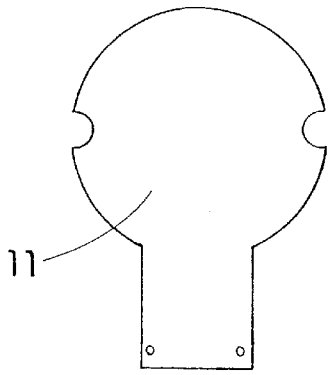
FIG. 4 is a front view of a front panel cut piece according to the above preferred embodiment of the present invention.
Figure 4A:
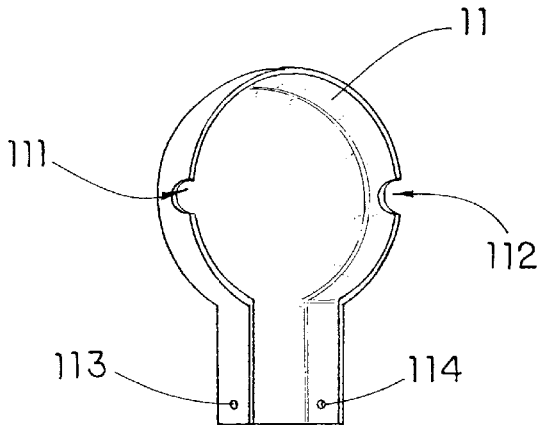
FIG. 4A is a front view of a front panel formed from the front panel cut piece as shown in FIG. 4 according to the above preferred embodiment of the present invention.

The front panel 11 is a made of a thin 0.76 mm brass sheet which is press but to a shape as shown in FIG. 4. Then, it is pressed to form a container shape having a deep of 5 mm for covering the light device 30 and the key organizer device 20, as shown in FIG. 4A. Two holes 111, 112 are formed in the middle on two sides which are respectively functioned as a light window and for positioning a switch button 31. A pin 14 is inserted between two small holes 113, 114 in the bottom on two sides to connect the back panel 12.

Figure 5:
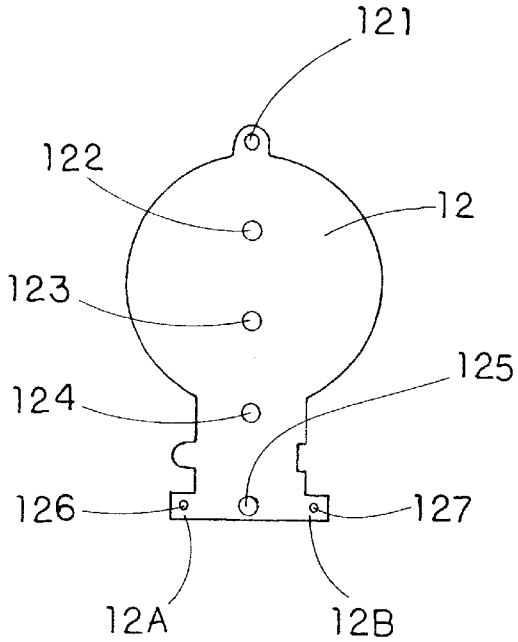
FIG. 5 is front view of a back panel cut piece according to the above preferred embodiment of the present invention.
Figure 5A:
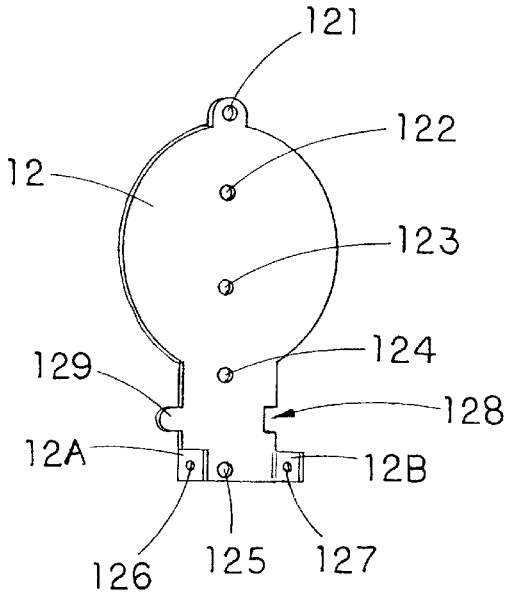
FIG. 5A is a front view of a back panel formed from the back panel cut piece as shown in FIG. 5 according to the above preferred embodiment of the present invention.

The back panel 12 is made of a thin 0.3 mm stainless steel sheet which is press cut a shape as shown in FIG. 5. Then, it is bent to form two connecting parts in two sides of the bottom thereof, as shown in FIG. 5A. The back panel 12 has seven holes form thereon by means of a punch processing, wherein a first hole 121 positioned at top of the back panel 12 is adapted to hang the complete holder 10 on to a key chain 41, two holes 122, 123 formed in the middle are for holding the light device 30, two holes in the bottom 124, 125 are for fixing the key organizer device 20, and two little holes 126, 127 on the connecting part 12*a*, 12*b* are for connecting the pin 14. A small square space 128 is cut out by press and a small half round shape 129 is formed near the bottom. The small square space 128 is for the thread 21 in and out. The half round shape 129 is a hand for a ring 231 of the self-retractable thread device 23, which is affixed at the first end 22 of the thread 21, to hand on to form a lock.

Figure 6A:
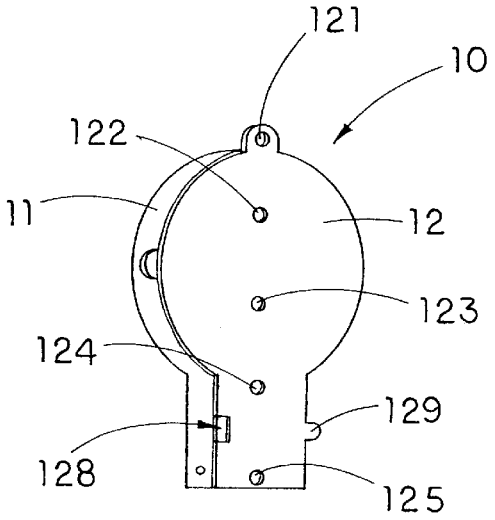
FIG. 6A is a perspective view of the connected front and back panels according to the above preferred embodiment of the present invention.

As shown in Figures. 6 and 6A, the pin 14 is inserted through the two small holes 113, 114 in a bottom on two sides of the front panel 11 and the two little holes 126, 127 provided on the two connecting part 12*a*, 12*b* of the back panel 12 so as to pivotally connect the front panel 11 and the back panel 12 together.

The key organizer device 20 of the present invention has an improvement from a prior application, where two arms have been substituted by the self retractable thread device 23.

Figure 8:
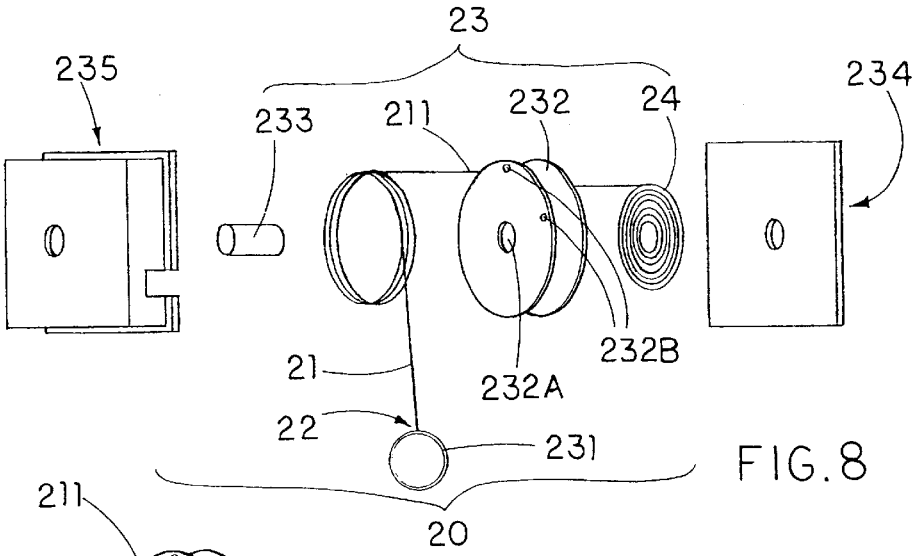
FIG. 8 is an exploded view of the parts of the key organizer of the key light holder according to the above preferred embodiment of the present invention.
Figure 8A:
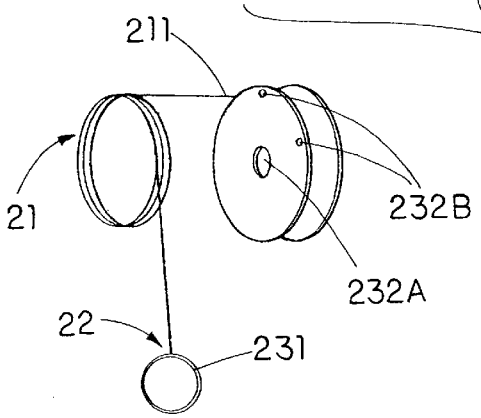
FIG. 8A is a schematic view illustrating that a thread ties a wheel and a ring according to the above preferred embodiment of the present invention.
Figure 8C:
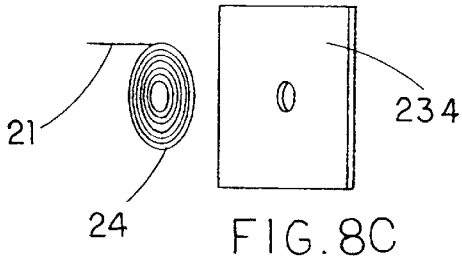
FIG. 8C is a schematic view illustrating that a coil spring center end on a metal basis according to the above preferred embodiment of the present invention.
Figure 8B:
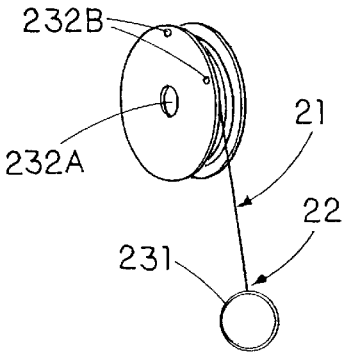
FIG. 8B is a schematic view illustrating that the thread coils on the wheel according to the above preferred embodiment of the present invention.
Figure 8D:
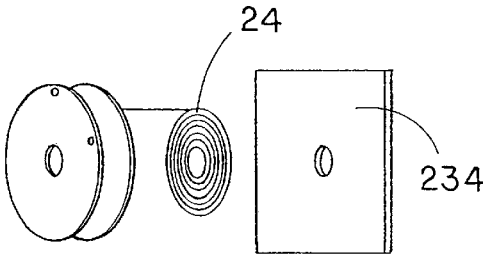
FIG. 8D is a schematic view illustrating the spring out circle end on the wheel according to the above preferred embodiment of the present invention.
Figure 8E:
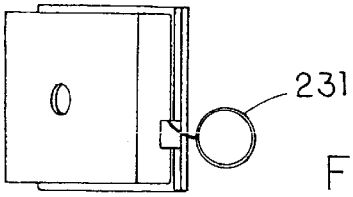
FIG. 8E is a schematic view illustrating the key organizer formed according to the above preferred embodiment of the present invention.

As shown in FIGS. 8 to 8E, the self retractable thread device 23 comprises the ring 231, a wheel 232, an axle 233, and a basis element 234. The wheel 232 is made out by metal that has a thickness of 2 mm and a diameter of 10 mm. The wheel 232 has wheel 232 has a circle hole 232*a* positioned in a middle and two holes 232*b* located close to its circle and one hole. The thread 21 is made of durable material such as nylon and preferred have a length of 80 mm and a diameter of 1 mm. The thread 21 has a second end 211 tied on the circle hole 232*a* of the wheel 232 while the first end 22 tied to the ring 231, as shown in FIG. 8A. The thread 21 is coiled on the wheel 232 from the first end 211 and is capable of extending out by pulling out the ring 231 to form a lock for organizing keys 40, as shown in FIG. 8B.

The ring 231, which has a diameter of 5 mm, is made of flexible metal. The ring 231 ties the thread 21 together, as shown in FIG. 8A. Pulling out the ring 231 will bring the thread 21 out. Handing the ring 231 on the hand will form a lock to organize the keys 40.

The key organizer device 20 further comprises a retractable unit 24 installed between the basis element 234 and the wheel 232 for enabling the wheel 232 to move on the axle 233 by pulling the ring 231 out and retracting the thread 21 when releasing the ring 231.

The retractable unit 24 is a coil spring which has a center end tied on a center of the basis element 234 and an other end tied on the circle hole 232*a* of the wheel 232. The axle 233 is placed through the center hole 232*a* of the wheel 232 to the basis element 234 so as to tighten the center end of the coil spring 24 onto the basis element 234. Moreover, a cover 235 is used to place over the wheel 232, the coil spring 23 and the basis element 234, which limits the wheel 232 can only move inside the cover space13, as shown in FIG. 8E.

The coil spring 24 has a 8 mm diameter and is made of flexible metal. The center end of the coil spring 24 is tied on the center of the basis element 234, as shown in FIG. 8C. Other end of the spring 24 is tied on the circle hole 232*a* of the wheel, as shown in FIG. 8D. When the wheel 232 rotates, it forces the spring 24 to rotate about the spring center. This force is transferred into the coil spring 24. The coil spring 24 will force the wheel 232 rotating back. The wheel 232 rotating back makes the thread 21 retracting back.

The axle 233 is placed through the wheel center hole 232*a* to the center of the basis element 234. The axle 233 will tighten the spring center end onto the basis element 234 too. The wheel 232 moves on the axle 233 by pulling the ring 231 out and releasing the ring 231. The axle 233 does not move.

Figure 7A:
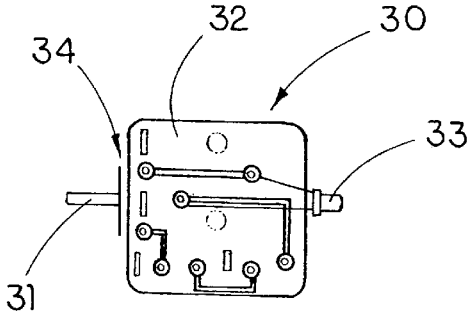
FIG. 7A is a front view of the light device formed according to the above preferred embodiment of the present invention.

As shown in FIGS. 7, 7A, 9, and 11, the light device 30 comprises a rubber made switch button 31 affixed on a circuit board 32, at least a 1.5V cell battery to power up at least a LED light 33, and a press switch 34 made by copper wire and operated by the switch button 31, wherein FIG. 7A illustrates the press switch 34 connecting to the circuit board 32 when the LED light 33 on.

Figure 9:
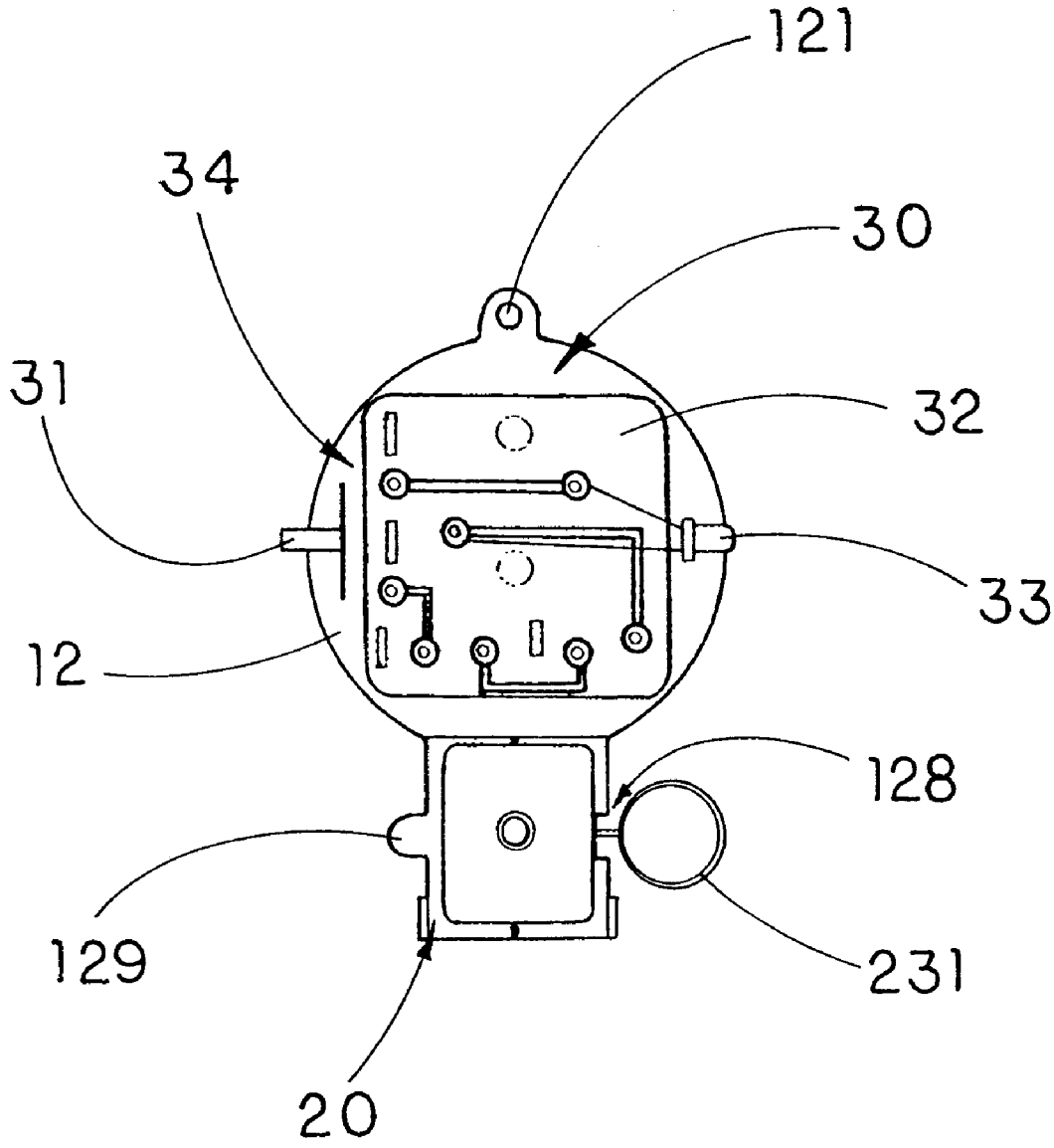
FIG. 9 is a back view of the back panel with the light device and key organizer according to the above preferred embodiment of the present invention.

The complete key light holder is formed by affixing the key organizer device 20 and the light device 30 on the back panel 12, as shown in FIG. 9, and combining the front and back panels 11, 12, as shown in FIG. 6A.

The manner of operating the key light holder to organize keys is described below.

Figure 10:
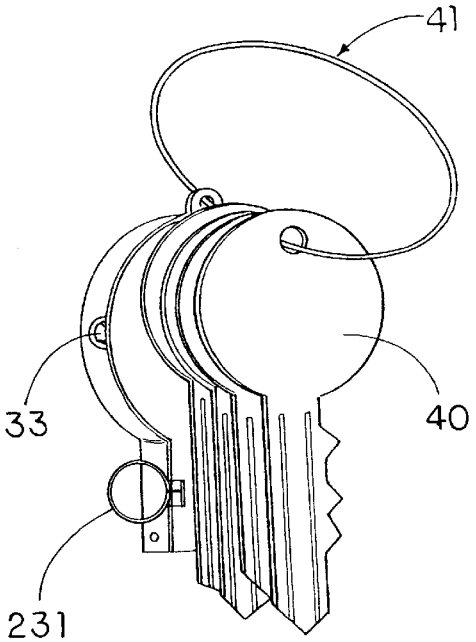
FIG. 10 is a schematic view illustrating the key light holder on key chain according to the above preferred embodiment of the present invention.
Figure 10A:
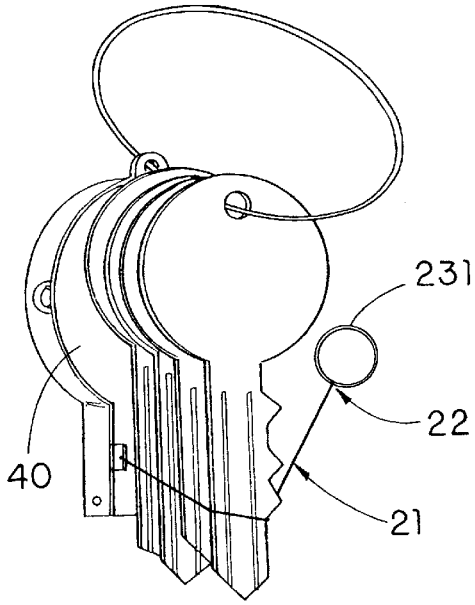
FIG. 10A is a perspective view illustrating how to organize keys and release keys according to the above preferred embodiment of the present invention.
Figure 11:
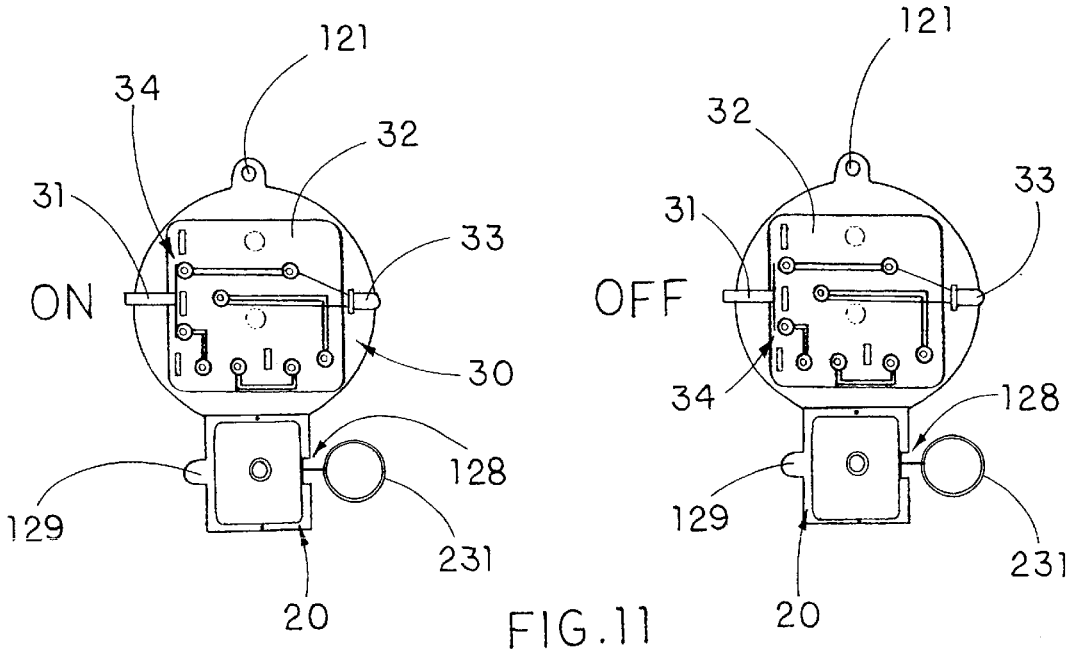
FIG. 11 contains two back view to respectively illustrate the light on and light off condition according to the above preferred embodiment of the present invention.

Put the key light holder into a key chain 41, as shown in FIG. 10. Pull the ring 231 out to tie the keys. Release the ring 231 and let the thread 21 retract back, as shown in FIG. 10A. To locate a key or a lick in dark, press the press button 31 to turn on the LED light 33, as shown in FIG. 11. A logo may be printed on face to decorate the key light holder.

In view of above, a number of advantages of the key light holder of the present invention become evident:

(a) One Pneumatic Press can do complete the jobs including cutting, punching, pressing, bending, riveting, and marking.

(b) A thin 0.76 mm brass and 0.3 mm stainless steel sheets are soft to cut and form. The front and back panels weight a key only.

(c) The light device and the key organizer device can be made separately.

(d) Assembly of all parts can be done by same Pneumatic Presses.

(e) The LED can be in many colors, such as red, yellow, blue, and etc.

(f) The key organizer device is in small size, so that it can tie different number key.

(g) The metal material has longer use life and environmental friendly.

(h) Lower the key noise when organizing the keys.

(i) Provide a light source in dark.

(j) Face creates area for an image imprint.

The present invention has further more advantages in use, such as it can be coated in many colors in face, a phone number can be printed on the back to help recover the key when lost, face area can be used to print logo, and metal can be recycled.

Although the description above contains many specificities, these should no be construed as limiting the scope of the invention but merely providing illustrations of the presently preferred embodiments of this invention. For example, the key light holder can have other shape, such as oval, triangular, and etc. Also, the holder can be made of other material, such as plastic and wood, etc.

I claim:

1. A key light holder, comprising:

a holder which comprises a front panel connected with a back panel to define a receiving chamber therein; and a key organizer device, which is affixed in said holder, comprising a thread having a first end capable of being extended from said holder for organizing keys when a pulling force is applied to said end of said thread, and a self retractable thread device for retracting said thread back into said holder when said pulling force is released, wherein said self retractable thread device comprises a wheel, a ring, an axle, and a basis element, said wheel having a circle hole, said thread being made of durable material and having a second end tied on said circle hole of said wheel while said first end tied to said ring, said thread being coiled on said wheel from said first end, said thread being capable of extending out by pulling out said ring to form a lock for organizing keys, said key organizer device further comprises a retractable unit installed between said basis element and said wheel for enabling said wheel to move on said axle by pulling said ring out and retracting said thread when releasing said ring.

2. A key light holder, as recited in claim 1, wherein said retractable unit comprises a coil spring, which has a center end tied on a center of said basis element and an other end tied on said circle hole of said wheel, said axle being placed through a center hole of said wheel to said basis element so as to tighten said center end of said coil spring onto said basis element.

3. A key light holder, as recited in claim 2, wherein said key organizer device further comprises a cover to place over said wheel, said coil spring and said basis.

4. A key light holder, as recited in claim 2, wherein said wheel has two holes located close to a circle thereof and one hole provided in a middle position.

5. A key light holder, as recited in claim 2, further comprising a light device which comprises at least a battery to power up at least a LED light, a press switch and a switch button affixed on a circuit board.

6. A key light holder, as recited in 5, wherein said front panel is pressed to form a container shape for covering said light device and said key organizer device, two holes are formed in a middle on two sides which are respectively functioned as a light window and for positioning said switch button.

7. A key light holder, as recited in 6, wherein a pin pivotally connects said front panel and said back panel together by inserting between two small holes in a bottom on two sides of said front panel to connect said back panel.

8. A key light holder, as recited in claim 7, wherein a small square space is cut out from said back panel and a small half round shape is formed near a bottom of said back panel, wherein said small square space is for said thread in and out and said half round shape is a hand for said ring to hand on to form a lock.

9. A key light holder, as recited in claim 5, wherein a small square space is cut out from said back panel and a small half round shape is formed near a bottom of said back panel, wherein said small square space is for said thread in and out and said half round shape is a hand for said ring to hand on to form a lock.

10. A key light holder, as recited in 2, wherein a pin pivotally connects said front panel and said back panel together by inserting between two small holes in a bottom on two sides of said front panel to connect said back panel.

11. A key light holder, as recited in claim 2, wherein said back panel is bent to form two connecting parts in two sides of a bottom thereof, said back panel further a first hole positioned at top of said back panel adapted for hanging said key lighter holder on to a key chain, two holes formed in said middle for holding said light device, two holes in said bottom are for fixing said key organizer device, and two little holes on a connecting part for connecting said pin.

12. A key light holder, as recited in claim 2, wherein a small square space is cut out from said back panel and a small half round shape is formed near a bottom of said back panel, wherein said small square space is for said thread in and out and said half round shape is a hand for said ring to hand on to form a lock.

13. A key light holder, as recited in claim 1, further comprising a light device which comprises at least a battery to power up at least a LED light, a press switch and a switch button affixed on a circuit board.

14. A key light holder, as recited in 13, wherein said front panel is pressed to form a container shape for covering said key organizer device, two holes are formed in a middle on two sides which are respectively functioned as a light window and for positioning said switch button.

15. A key light holder, as recited in 14, wherein a pin pivotally connects said front panel and said back panel together by inserting between two small holes in a bottom on two sides of said front panel to connect said back panel.

16. A key light holder, as recited in claim 13, wherein a small square space is cut out from said back panel and a small half round shape is formed near a bottom of said back panel, wherein said small square space is for said thread in and out and said half round shape is a hand for said ring to hand on to form a lock.

17. A key light holder, as recited in 1, wherein a pin pivotally connects said front panel and said back panel together by inserting between two small holes in a bottom on two sides of said front panel to connect said back panel.

18. A key light holder, as recited in claim 1, wherein said back panel is bent to form two connecting parts in two sides of a bottom thereof, said back panel further a first hole positioned at top of said back panel adapted for hanging said key lighter holder on to a key chain, two holes formed in said middle for holding said light device, two holes in said bottom are for fixing said key organizer device, and two little holes on a connecting part for connecting said pin.

19. A key light holder, as recited in claim 1, wherein a small square space is cut out from said back panel and a small half round shape is formed near a bottom of said back panel, wherein said small square space is for said thread in and out and said half round shape is a hand for said ring to hand on to form a lock.

* * * * *